United States Patent [19]

Francis

[11] Patent Number: 4,516,321

[45] Date of Patent: May 14, 1985

[54] SAFETY RAZORS

[75] Inventor: John F. Francis, Horsell, England

[73] Assignee: The Gillette Company, Boston, Mass.

[21] Appl. No.: 555,801

[22] Filed: Nov. 28, 1983

[30] Foreign Application Priority Data

Dec. 7, 1982 [GB] United Kingdom ..... 8234784
Oct. 11, 1983 [GB] United Kingdom ..... 8327094

[51] Int. Cl.[3] ..... B26B 21/22

[52] U.S. Cl. ..... 30/50; 30/47; 30/89; 30/346.58

[58] Field of Search ..... 30/50, 47, 346.5, 346.58, 30/346.59, 87, 89

[56] References Cited

U.S. PATENT DOCUMENTS

| | | | |
|---|---|---|---|
| 3,940,853 | 2/1976 | Francis | 30/346.58 |
| 4,084,316 | 4/1978 | Francis | 30/50 |
| 4,168,571 | 9/1979 | Francis | 30/47 |
| 4,266,340 | 5/1981 | Bowman | 30/50 X |
| 4,270,268 | 6/1981 | Jacobson | 30/47 |
| 4,281,455 | 8/1981 | Dixon | 30/89 X |

FOREIGN PATENT DOCUMENTS

| | | |
|---|---|---|
| 1487834 | 10/1977 | United Kingdom . |
| 1557843 | 12/1979 | United Kingdom . |
| 1565415 | 4/1980 | United Kingdom . |
| 1566505 | 4/1980 | United Kingdom . |
| 1588986 | 5/1981 | United Kingdom . |
| 2104430 | 3/1983 | United Kingdom . |

*Primary Examiner*—Jimmy C. Peters
*Attorney, Agent, or Firm*—Raymond J. De Vellis

[57] ABSTRACT

A tandem blade unit for use in a safety razor comprises a pair of wire-supported blades (i.e. narrow blade strips secured directly to elongate, wire-like support members) and optionally, additional wire like cap and guard members, held together to form a permanent integrated assembly by links directly moulded onto end portions of the components. Such units can be permanently incorporated into disposable razors or may be exchangeable in a purpose made co-operating razor handle.

10 Claims, 16 Drawing Figures

SAFETY RAZORS

This invention relates to safety razors and to blade units for use with or incorporation in such safety razors.

More specifically, the invention is concerned with blade units of the general form described in British Pat. No. 1487834, comprising a narrow elongate blade strip sharpened along one longitudinal edge and an elongate, wire-like support formed over a length at least equal to the length of the blade strip with a substantially flat surface to which one face of the blade strip is directly attached, with the cutting edge of the strip projecting forwardly of the support and with the end portions of the support projecting beyond the ends of the blade strip.

A blade unit of this form is hereinafter referred to for convenience as a "wire-supported blade".

Some forms of razor incorporating wire-supported blades are described in British Pat. No. 1566505 and No. 1557843.

Wire-supported blades may be given a very small width and depth to advantage with respect both to manufacturing costs and compactness of the razor heads in which they are employed. They do, however, due to their very compactness, present problems in handling during manufacture, and in assembly of razor heads, as well as in packaging and dispensing when designed as exchangeable blade units.

In accordance with a feature of the present invention, these drawbacks are greatly reduced by the provision of a blade unit for use in a safety razor, comprising a pair of "wire supported blades" (as herein defined) and a pair of links disposed at opposite ends thereof, each link being moulded directly onto the adjacent end portions of the supports to form a permanent integrated assembly in which the two blade strips are held in spaced parallel relation.

Tandem blade units of this form can be incorporated permanently in disposable razors, or in razor frames to make up exchangeable blade cartridges, or may themselves constitute exchangeable blade unit cartridges for releasable mounting in a razor.

In the case in which the unit is to form part of a disposable razor, the wire-supported blade may be supplemented by further elongate members constituting guard and cap members, respectively, whose end portions are also secured in the moulded links. This integrated assembly can then be assembled into a simple handle to complete the razor.

In each case, the links may be of rigid materials, of the elastomeric material in order to permit, in use of the tandem blade units in shaving, some degree of movement of the wire-supported blades relative to each other and/or to other skin engaging members of the razor, such as the guard and the cap.

Some tandem blade units and razors incorporating them, all in accordance with the invention, will now be described, by way of example, with reference to the accompanying drawings, in which.

Figure 1:
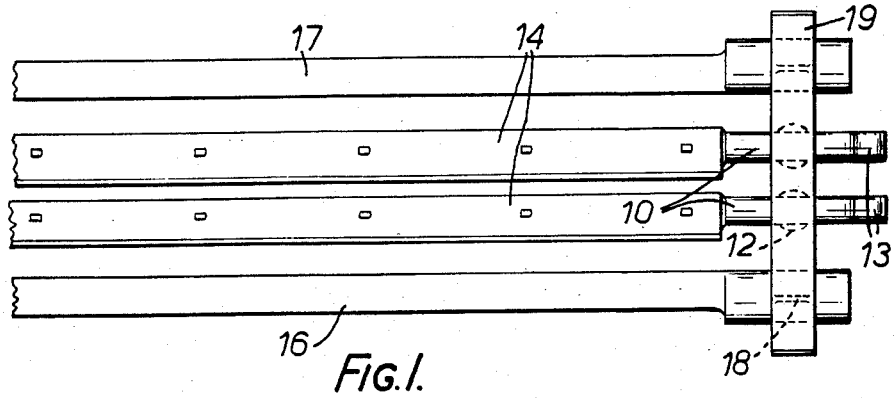
FIGS. 1 and 2 are scrap top plan and side views respectively of a first form of tandem blade unit.

The unit shown in FIGS. 1 to 4 comprises a pair of blade supports 10 formed from round soft steel wire, press-deformed over the major part of their lengths to present opposed, parallel flat surfaces 11. The end portions of the supports are generally circular, except for locally raised tabs 12, and the outermost end portions 13 turn downwardly.

Two blade strips 14 each having a sharpened longitudinal edge 15 are secured to the upper flat surfaces 11, preferably by spot-welding or by the process described in our co-pending patent application No. 8125748, with the sharpened edges 15 projecting forwardly, clear of the supports 10.

The unit also includes a guard member 16 and a cap member 17, again formed from soft steel circular wire press-formed over the major part of their lengths to a generally rectangular cross-section. The round end portions are also formed with locally raised tabs 18.

These four skin-engaging components are secured together in spaced parallel relation by end links 19 formed of rigid plastics or elastomeric material moulded about the end portions of the four wires in the regions of the tabs 12 and 18, which ensure a secure mechanical key between the links and the wire members.

There is thus formed an integrated unit ready for assembly with a razor handle, in this case to form a disposable razor which is discarded as a whole when the cutting edges become unacceptably dulled. The unit is extremely compact, the links measuring only 8 mm×3 mm.

Figure 5:
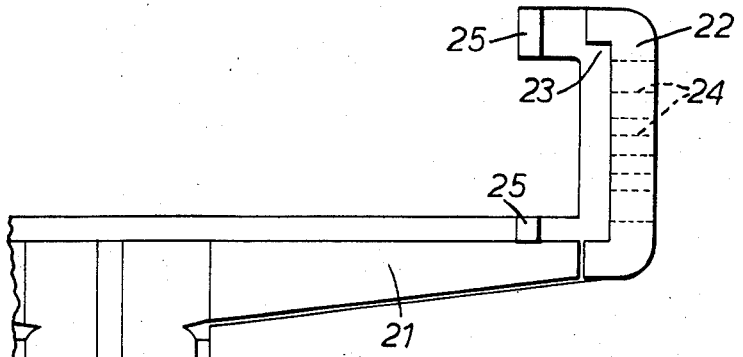
FIGS. 5, 6 and 7 are scrap plan, front and end views, respectively, of a razor handle for use with the unit of FIGS. 1 to 4.
Figure 6:
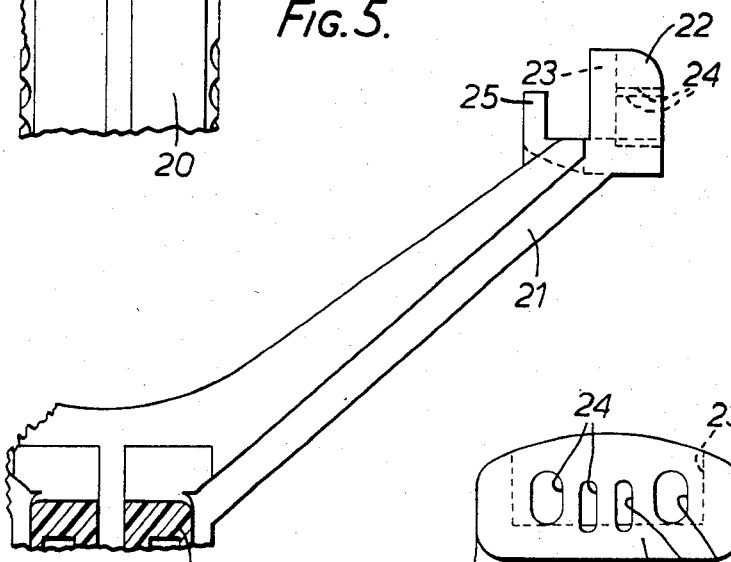
Figure 7:
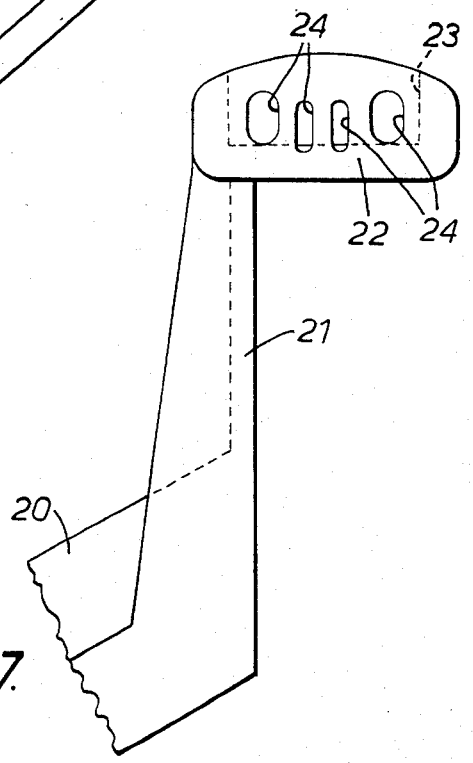

A razor handle to accept the above described unit is illustrated in FIGS. 5 to 7. The handle is a unitary plastics moulding comprising an elongate grip portion 20 and a pair of upwardly diverging yoke arms 21 each terminating at an upwardly projecting ear 22, recessed at 23 on its inner face to receive one link 19 of the unit, and having in its outer wall four through holes 24 to receive the end portions of the four wire members.

The tandem blade unit is simply fitted between the ears 22, the resilience of the yoke arms 21 permitting sufficient deflection to engage the wire end portions in the holes 24. If the links 19 are made of elastomeric material, the projecting wire portions are normally held against the upper ends of the elongate holes 24, but under the forces imposed on the skin engaging members during shaving, the links may yield locally to permit small movements of the respective end portions independently of each other to provide additional degrees of conformance to the facial contours being shaved. The downturned end portions 13 engage in the respective elongate holes 24 to key the supports against rotation about their longitudinal axes. Small rectangular posts 25 are positioned to engage the flat outer sides of the cap and guard wire members 16, 17 to inhibit them from twisting in use of the razor.

Figure 8:
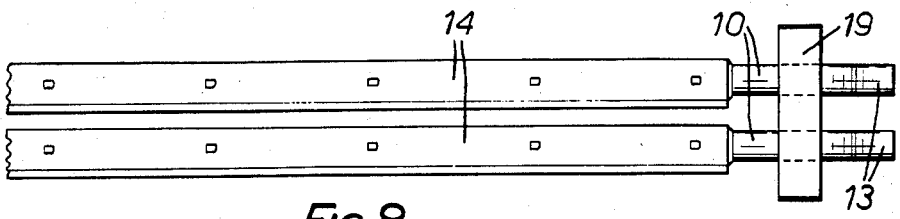
FIGS. 8 and 9 are scrap top plan and side views of a second form of tandem blade unit.
Figure 9:
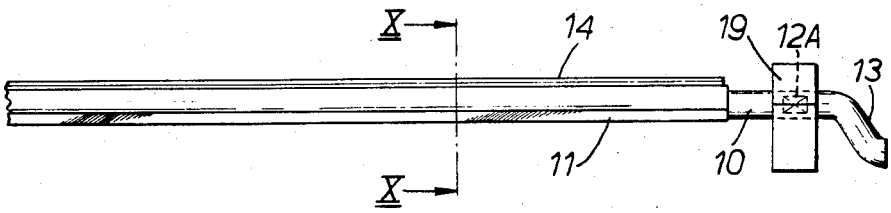
Figure 10:
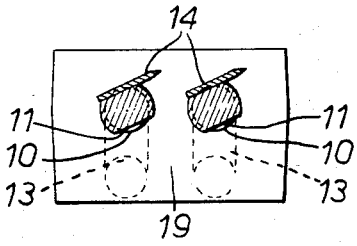
FIG. 10 is a section on the line X—X of FIG. 9.
Figures 11, 12:
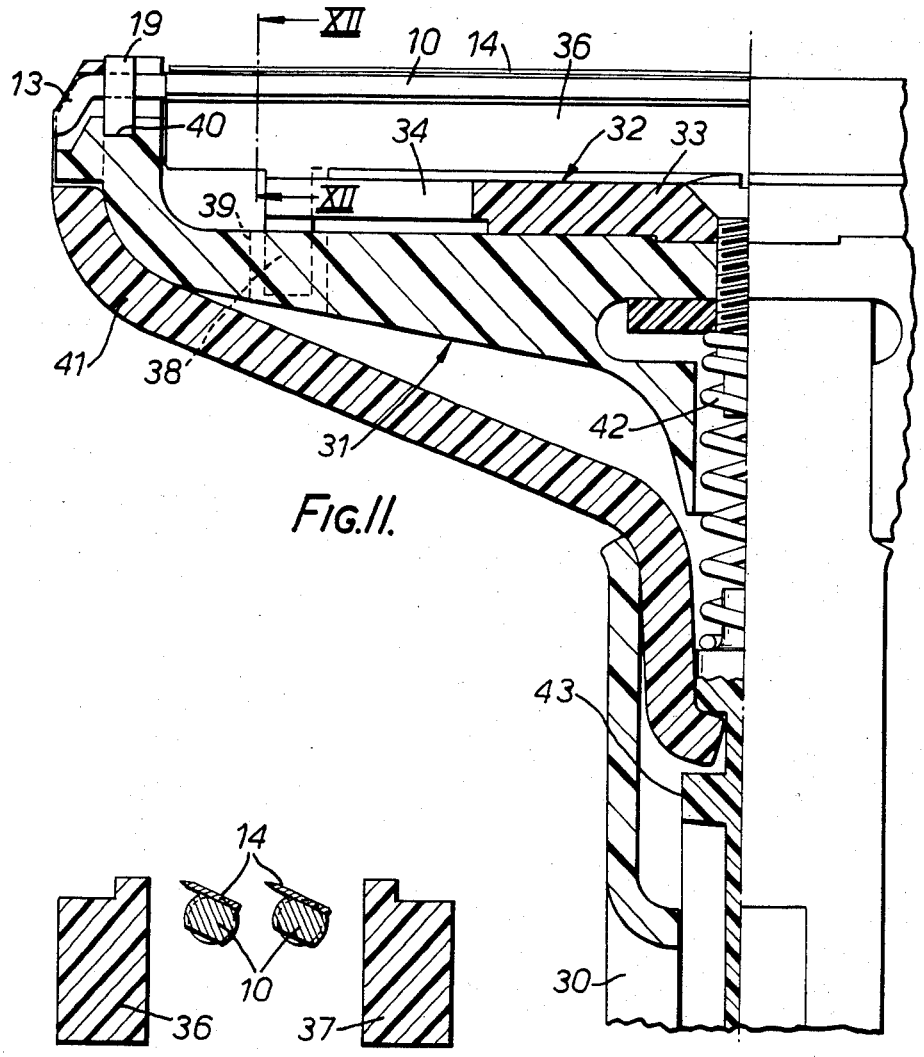
FIG. 11 is a scrap front view partially sectioned, of a razor fitted with the unit of FIGS. 8 to 10.
FIG. 12 is a section on the line XII—XII in FIG. 11.
Figure 13:
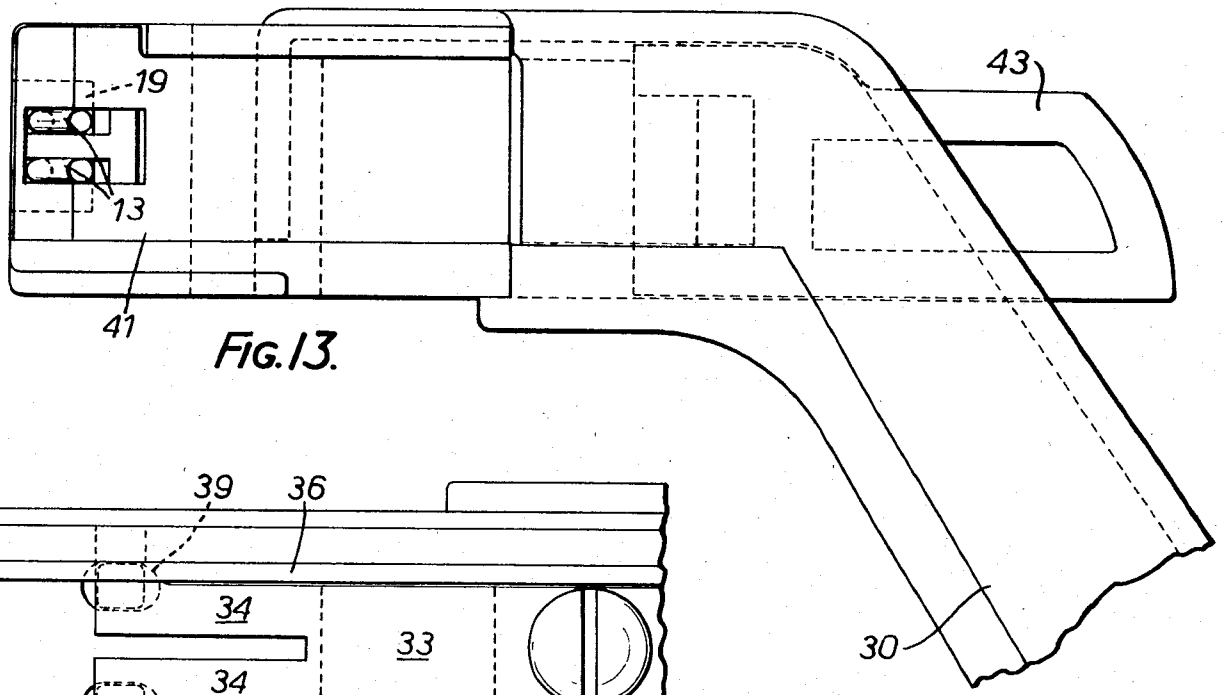
FIG. 13 is an end view of the razor of FIG. 11.
Figure 14:
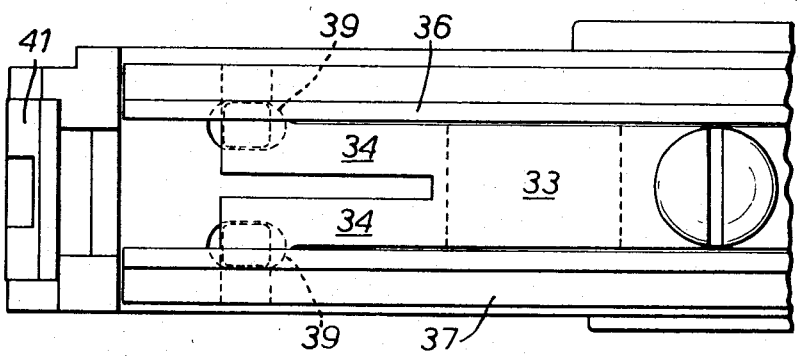
FIG. 14 is a scrap top plan view of the razor of FIG. 11, with the blade unit omitted in the interest of clarity.

The tandem blade unit shown in FIGS. 8, 9 and 10 consists of two blade supports 10 and blade strip 14 held in spaced parallel relation be moulded end links 19. The unit differs from that of FIGS. 1 to 4 mainly in omitting the members 16 and 17. One small variant applicable to both units is that small flats 12A are formed in the regions embedded in the links instead of raised tabs 12, to assist mechanical keying of the links to the wire supports.

Once again, the links may be of rigid or elastomeric material, but they are preferably elastomeric when intended for use with the razor illustrated in FIGS. 11 to 14, which will now be described in detail.

The razor includes an elongate grip portion 30 fast with a transverse head frame 31, to which is firmly secured a plastics moulding 32 comprising a central part 33 secured to the frame 31, the end portions of which form bifurcated spring fingers 34 integrally connected at their free ends to a guard member 36 and a cap member 37 respectively, so that both of these members can be deflected resiliently at one end relative to the other, or at both ends in unison, for conformance with facial contours being shaved in use of the razor. Lateral movement of the cap and guard member is prevented by the engagement of depending pegs 38 into guide slots 39 formed in the frame 31.

The ends of the frame 31 turn upwardly and present recesses 40 open from above to receive the end links 19 of the tandem blade unit. In the closed condition of the razor, the links 19 are accommodated in the recesses and are firmly trapped in place by respective yoke arms 41 apertured to engage over the projecting ends of the supports 10.

The yoke arms 41 are urged into the closed, operative position illustrated, by a yoke spring 42, but can be swung outwardly in unison by operation of a push button 43, to an inoperative position in which they are clear of the recesses for the purpose of releasing a blade unit to be discarded, and of loading of a replacement blade unit.

The tandem blade units are preferably packed in containers which hold a number of such units to protect their cutting edges in transit and storage and which also facilitate loading of the units one-by-one as required onto a razor handle, without the user needing to touch the units. A suitable dispenser may be of the general form described in British Pat. No. 1588986 but modified to take account of the fact that the individual wire-supported blades are now combined into an integrated unit.

Figure 2:
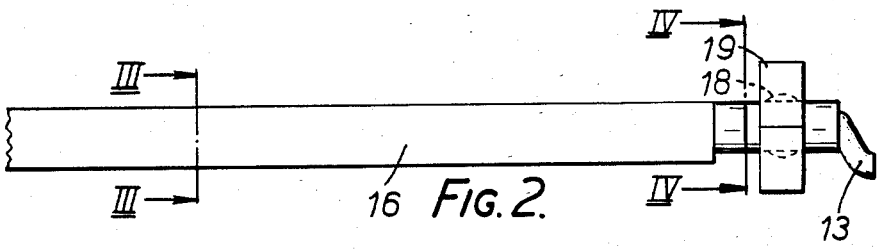
Figure 3:
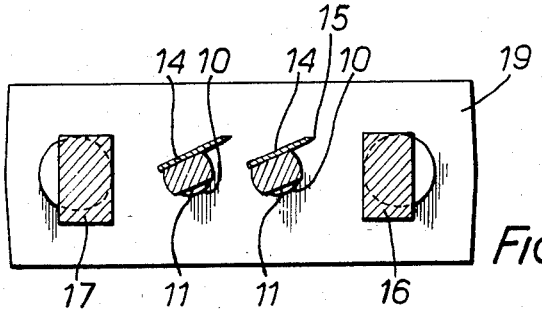
FIGS. 3 and 4 are sections on the lines III—III and IV—IV, respectively, of FIG. 2.
Figure 4:
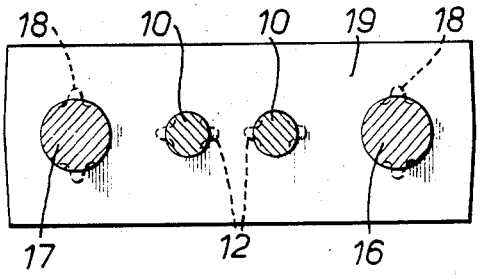
Figure 15:
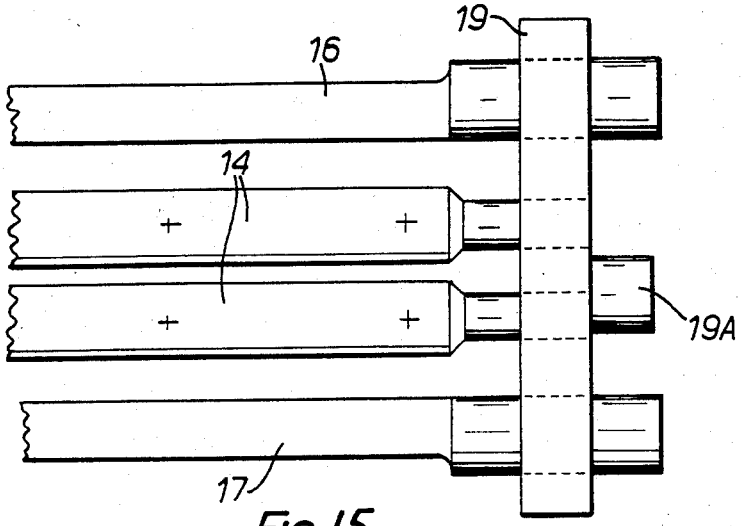
FIGS. 15 and 16 are a scrap plan view and an end view respectively of a further form of blade unit.
Figure 16:
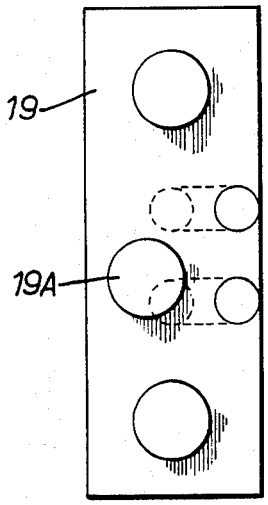

In another variant of the invention, illustrated in FIGS. 15 and 16, the blade unit is generally similar to that of FIGS. 1 and 2, the main differences being that the projecting end portions of the blade supports 10 terminate flush with the outer faces of the respective adjacent links 19, and each outer face has a projecting stud 19A of circular section which acts as a pivotal mounting means by which the unit can be grasped in a razor with freedom to pivot about the common axis of the respective studs in use of the completed razor.

Once again the unit may be incorporated as a permanent part of a disposable razor or as a replaceable cartridge.

The blade unit of FIGS. 15 and 16 may also be employed in a razor which holds the unit in a fixed position, the studs 19A in that case being used merely to assist in correct location of the unit on the razor head.

I claim:

1. A tandem blade unit for use in a safety razor, said tandem blade unit comprising: a pair of wire-supported blades, each said wire supported blade comprising a narrow elongate blade strip sharpened along one longitudinal cutting edge thereof and an elongate wire-like support formed over a length at least equal to the length of said blade strip with a substantially flat surface is directly attached, with the said cutting edge of said strip projecting forwardly of said support and with opposite end portions of said support projecting beyond the respective ends of said blade strips; and a pair of links disposed at opposite ends of said pair of wire-supported blades, each said link being moulded directly onto adjacent said end portions of said supports to form a permanent integrated assembly in which said blade strips are held in spaced parallel relation.

2. A tandem blade unit according to claim 1, wherein said end portions of said supports are of generally circular cross-section, but are locally deformed to a non-circular section in the regions in which they are embedded in said links.

3. A tandem blade unit according to claim 1 wherein said links are made of an elastomeric material.

4. A tandem blade unit according to claim 1, further comprising an elongate cap member and an elongate guard member one to either side of said wire supported blades, said members each having opposite end portions which are also moulded into said links to form part of said integrated assembly.

5. A blade unit in accordance with claim 1, in combination with a razor handle in which said blade unit is permanently mounted to form a disposable razor.

6. A disposable razor combination according to claim 5, wherein said razor handle comprises an elongate grip portion having at its upper end a divergent pair of arms, each said arm terminating at its upper end in a projecting ear recessed at its inner face to accommodate one said link, and apertured to receive the adjacent said projecting end portions of said supports.

7. A disposable razor combination according to claim 6, wherein said links are made of elastomeric material and said apertures in said ears are elongated to permit some movement of said wire supported blades relative to each other.

8. A tandem blade unit in accordance with claim 1, in combination with a razor handle having a head frame, said head frame including means for releasably mounting said blade unit on said head frame.

9. A combination in accordance with claim 8, in which said head frame of said razor handle has opposed end portions formed with recesses, open from above, to accommodate said links of said unit, said razor handle further comprising a pair of respective arms and means for moving said arms in unison between an operative position in which said arms engage over said recesses to prevent movement of said links out of said recesses, and an inoperative position clear of said recesses to permit removal and mounting of said blade units from and onto said head frame.

10. A tandem blade unit according to claim 1, wherein each of said links has an outer face on which it is formed with pivotal mounting means on a common pivotal axis, by which said unit can be grasped in a co-operating razor handle with freedom to pivot about said axis.

* * * * *